US005764153A

United States Patent [19]

Vedaa

[11] Patent Number: 5,764,153

[45] Date of Patent: Jun. 9, 1998

[54] PRESSURE CONTROLLED ALARM CLOCK SYSTEM

[76] Inventor: Richard M. Vedaa, 18610 176th Ave. NE, Woodinville, Wash. 98072

[21] Appl. No.: 753,742

[22] Filed: Nov. 29, 1996

[51] Int. Cl.[6] ..... G08B 21/00

[52] U.S. Cl. ..... 340/666; 200/85 R; 368/12

[58] Field of Search ..... 340/666, 390.15, 340/573; 73/644; 367/104, 172; 338/114; 307/119; 200/85 R; 368/11, 12

[56] References Cited

U.S. PATENT DOCUMENTS

| | | | |
|---|---|---|---|
| 2,460,133 | 1/1949 | Pedus | 368/12 |
| 3,961,201 | 6/1976 | Rosenthal | 340/666 |
| 4,020,482 | 4/1977 | Feldl | 340/666 |
| 4,453,052 | 6/1984 | Semian et al. | 200/85 R |
| 4,638,307 | 1/1987 | Swartout | 340/666 |
| 4,845,323 | 7/1989 | Beggs | 200/85 R |
| 5,118,910 | 6/1992 | Duhon et al. | 340/666 |

*Primary Examiner*—Jeffery A. Hofsass
*Assistant Examiner*—John Tweel, Jr.

[57] ABSTRACT

A new Pressure Controlled Alarm Clock System for providing an alarm clock alarm which can not be turned off unless a user is removed from a bed, and where the alarm restarts if the user returns to the bed in a predetermined amount of time. The inventive device includes an alarm clock, a pressure switch normally open and in communication with the alarm clock to control the alarm, the pressure switch is positioned mesial a box spring and a mattress for determing if the user is in or out of the bed. The pressure switch further includes an adjustment member for adjusting the sensivity of the pressure switch. A heat sensing pad may be utilized as an alternative to the pressure switch thereby detecting the user's body heat near the surface of the mattress.

6 Claims, 2 Drawing Sheets

FIG 3
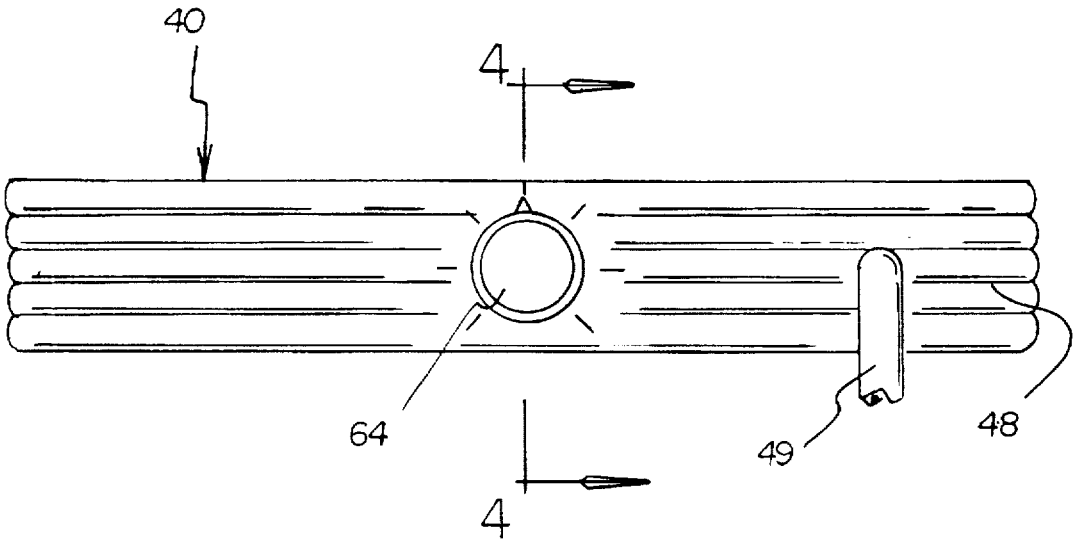
FIG 4
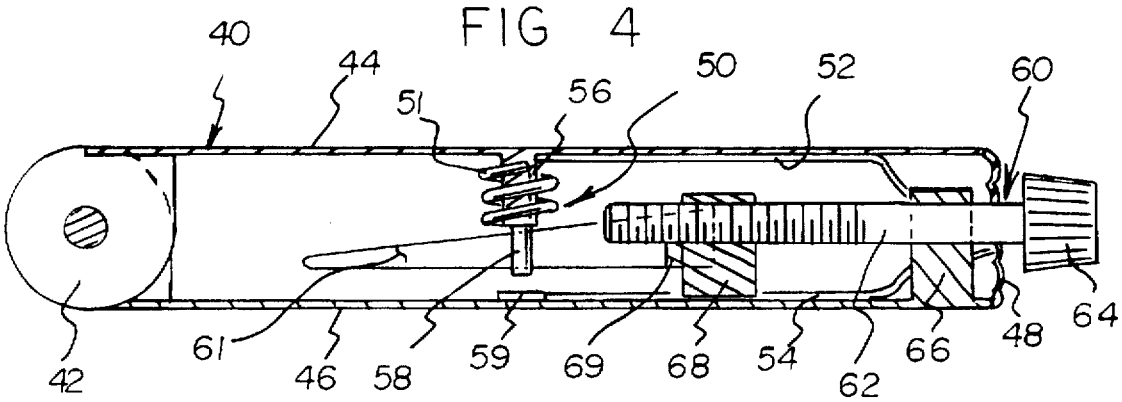
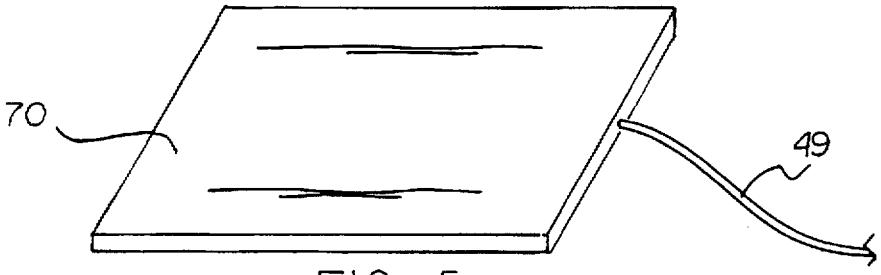
FIG 5

PRESSURE CONTROLLED ALARM CLOCK SYSTEM

BACKGROUND OF THE INVENTION

1. Field of the Invention

The present invention relates to Alarm Clock Devices and more particularly pertains to a new Pressure Controlled Alarm Clock System for providing an alarm clock alarm which can not be turned off unless a user is removed from a bed, and where the alarm restarts if the user returns to the bed in a predetermined amount of time.

2. Description of the Prior Art

The use of Alarm Clock Devices is known in the prior art. More specifically, Alarm Clock Devices heretofore devised and utilized are known to consist basically of familiar, expected and obvious structural configurations, not withstanding the myriad of designs encompassed by the crowded prior art which have been developed for the fulfillment of countless objectives and requirements.

Known prior art Alarm Clock Devices include U.S. Pat. Nos. 4,316,271; 4,172,216; U.S. Des. Pat. No. 358,775; U.S. Pat. Nos. 5,193,669; 5,019,950 and 3,961,201.

While these devices fulfill their respective, particular objectives and requirements, the aforementioned patents do not disclose a new Pressure Controlled Alarm Clock System. The inventive device includes an alarm clock, a pressure switch normally open and in communication with the alarm clock to control the alarm, the pressure switch is positioned mesial a box spring and a mattress for determining if the user is in or out of the bed.

In these respects, the Pressure Controlled Alarm Clock System according to the present invention substantially departs from the conventional concepts and designs of the prior art, and in so doing provides an apparatus primarily developed for the purpose of providing an alarm clock alarm which can not be turned off unless a user is removed from a bed, and where the alarm restarts if the user returns to the bed in a predetermined amount of time.

SUMMARY OF THE INVENTION

In view of the foregoing disadvantages inherent in the known types of Alarm Clock Devices now present in the prior art, the present invention provides a new Pressure Controlled Alarm Clock System construction wherein the same can be utilized for providing an alarm clock alarm which can not be turned off unless a user is removed from a bed, and where the alarm restarts if the user returns to the bed in a predetermined amount of time.

The general purpose of the present invention, which will be described subsequently in greater detail, is to provide a new Pressure Controlled Alarm Clock System apparatus and method which has many of the advantages of the Alarm Clock Devices mentioned heretofore and many novel features that result in a new Pressure Controlled Alarm Clock System which is not anticipated, rendered obvious, suggested, or even implied by any of the prior art Alarm Clock Devices, either alone or in any combination thereof.

To attain this, the present invention generally comprises an alarm clock, a pressure switch normally open and in communication with the alarm clock to control the alarm, the pressure switch is positioned mesial a box spring and a mattress for determining if the user is in or out of the bed.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Pressure Controlled Alarm Clock System apparatus and method which has many of the advantages of the Alarm Clock Devices mentioned heretofore and many novel features that result in a new Pressure Controlled Alarm Clock System which is not anticipated, rendered obvious, suggested, or even implied by any of the prior art Alarm Clock Devices, either alone or in any combination thereof.

It is another object of the present invention to provide a new Pressure Controlled Alarm Clock System which may be easily and efficiently manufactured and marketed.

It is a further object of the present invention to provide a new Pressure Controlled Alarm Clock System which is of a durable and reliable construction.

An even further object of the present invention is to provide a new Pressure Controlled Alarm Clock System which is susceptible of a low cost of manufacture with regard to both materials and labor, and which accordingly is then susceptible of low prices of sale to the consuming public, thereby making such Pressure Controlled Alarm Clock System economically available to the buying public.

Still yet another object of the present invention is to provide a new Pressure Controlled Alarm Clock System which provides in the apparatuses and methods of the prior art some of the advantages thereof, while simultaneously overcoming some of the disadvantages normally associated therewith.

Still another object of the present invention is to provide a new Pressure Controlled Alarm Clock System for providing an alarm clock alarm which can not be turned off unless a user is removed from a bed, and where the alarm restarts if the user returns to the bed in a predetermined amount of time.

Yet another object of the present invention is to provide a new Pressure Controlled Alarm Clock System which includes an alarm clock, a pressure switch normally open and in communication with the alarm clock to control the alarm, the pressure switch is positioned mesial a box spring and a mattress for determining if the user is in or out of the bed.

Still yet another object of the present invention is to provide a new Pressure Controlled Alarm Clock System that prevents the user from oversleeping, thereby eliminating the user from becoming late for work, appointments, or other important events.

Even still another object of the present invention is to provide a new Pressure Controlled Alarm Clock System that restarts the alarm if the user returns back to bed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an end view of the present invention disclosing the knob of the weight adjustment means.

FIG. 4 is a cross sectional view taken along line 4—4 of FIG. 3 disclosing the pressure switch and the weight adjustment means.

FIG. 5 is an upper side perspective view of an alternative embodiment comprising a heat sensing pad.

DESCRIPTION OF THE PREFERRED EMBODIMENT

Figure 1:
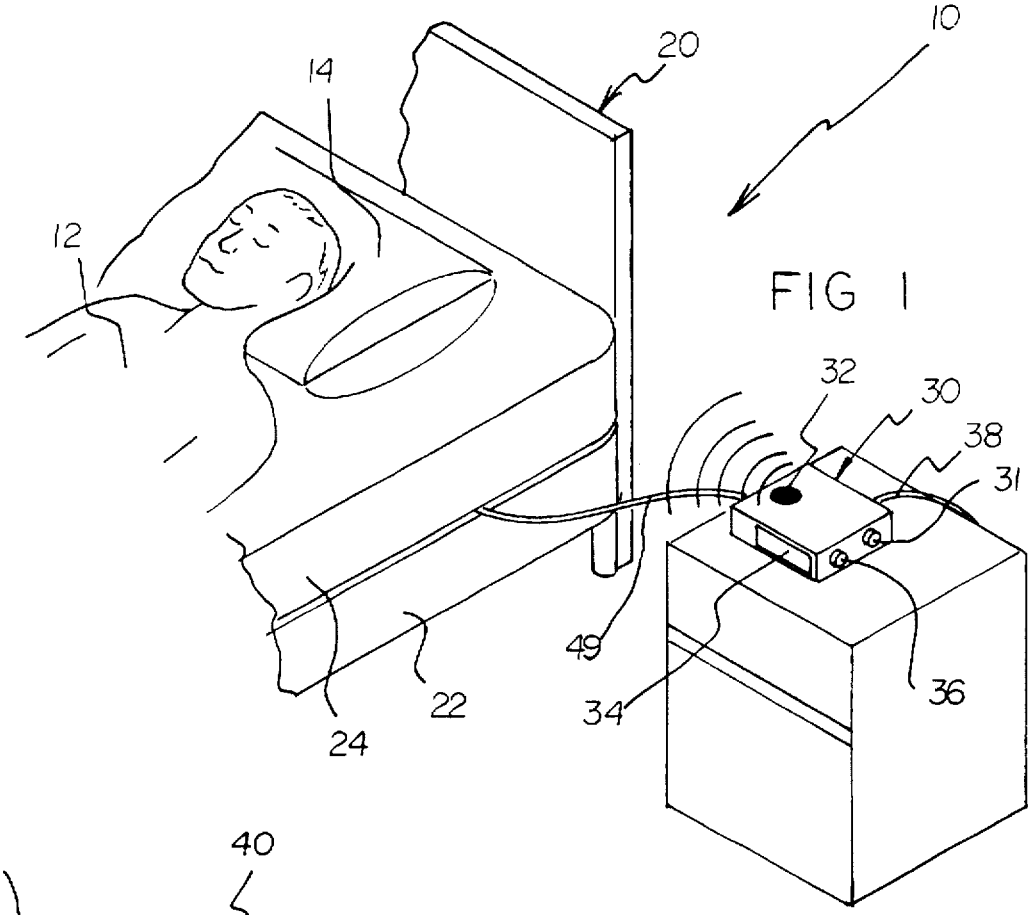
FIG. 1 is an upper side perspective view of a new Pressure Controlled Alarm Clock System according to the present invention.

With reference now to the drawings, and in particular to FIGS. 1 through 5 thereof, a new Pressure Controlled Alarm Clock System embodying the principles and concepts of the present invention and generally designated by the reference numeral 10 will be described.

More specifically, it will be noted that the Pressure Controlled Alarm Clock System 10 comprises an alarm clock 30 programmable to sound an alarm at a preset time, and a pressure sensing means 40 connected to the alarm clock 30 and positioned mesial a box spring 22 and a mattress 24 of a bed 20. The pressure sensing means 40 may be connected to the alarm clock 30 by a communication cable 49 or by a wireless signal means. The weight of a user 12 forces the mattress 24 upon the pressure sensing means 40 which allows the alarm clock 30 to sound the alarm and upon the user's 12 removal from the bed 20 the alarm is terminated.

Figure 2:
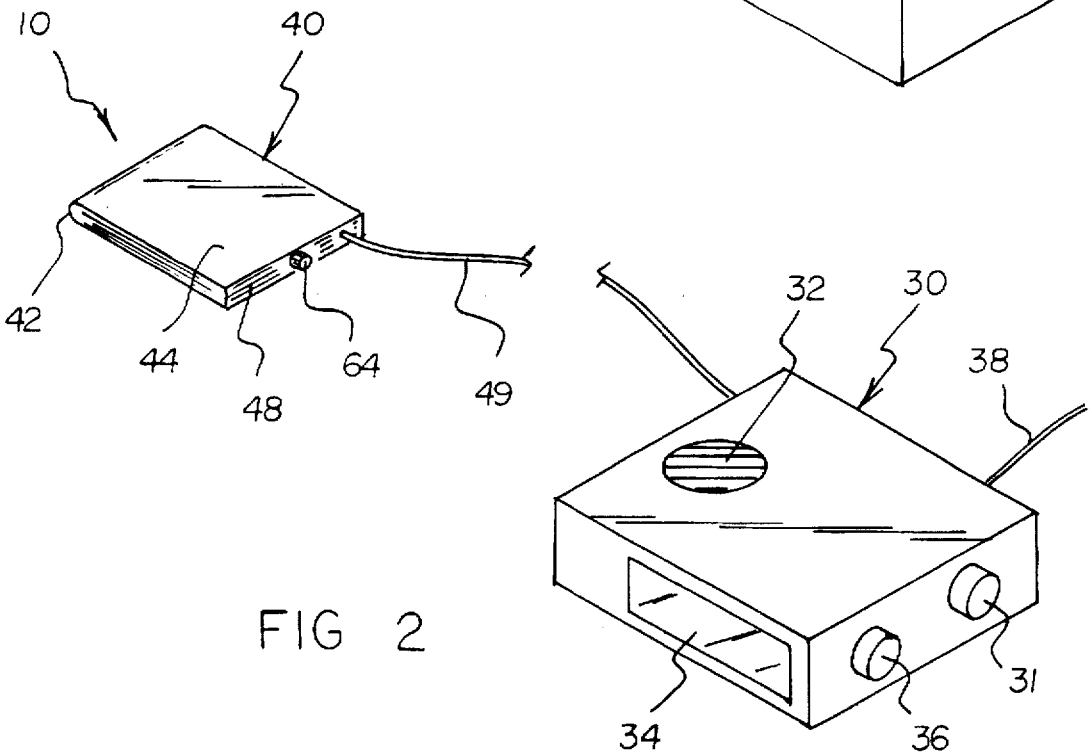
FIG. 2 is an upper side perspective view of the present invention.

As best illustrated in FIGS. 2 through 4, it can be shown that the pressure sensing means 40 comprises a cylinder 42. An upper plate 44 is pivotally secured to the cylinder 42. A lower plate 46 is pivotally secured to the cylinder 42 forming a syncline shape with the upper plate 44. A pressure switch 50 is positioned mesial the upper plate 44 and the lower plate 46 as best shown in FIG. 4 of the drawings. The pressure switch 50 is in communication with the alarm clock 30 controlling the alarm.

As shown in FIG. 4 of the drawings, the pressure switch 50 has an upper electrode 52 juxtaposed to an inner surface of the upper plate 44 and is electrically coupled to the alarm clock 30 by a communication cable 49. A lower electrode 54 is juxtaposed to an inner surface of the lower plate 46 and is electrically coupled to the alarm clock 30 by the communication cable 49 also. An insulated tube 56 is secured orthogonally to the inner surface of the upper plate 44 concentrically. The upper electrode 52 projects into the insulated tube 56. An upper contact 58 extends from within the insulated tube 56 a finite distance towards the lower plate 46. The upper contact 58 is electrically coupled to the upper electrode 52. An insulated compression spring 51 is preferably slidably surrounding the insulated tube 56. The spring is mesial the upper plate 44 and the lower plate 46 for forcing the plates apart during operation of the present invention. A lower contact 59 is secured to the inner surface of the lower plate 46 and is electrically coupled to the lower electrode 54. The lower contact 59 becomes electrically engaged to the upper contact 58 upon an application of force by the user's 12 weight upon the mattress 24 thereby closing a circuit through the communication cable 49 to allow sounding of the alarm.

As further disclosed in FIGS. 2 through 4, the pressure switch 50 has a weight adjustment means 60 for allowing the user 12 to preset the weight sensitivity of the pressure switch 50. The weight adjustment means 60 has a support member 66 secured to the inner surface of the lower plate 46 opposite of the cylinder 42 orthogonally. A threaded shaft 62 rotatably projects through the support member 66 parallel to the lower plate 46. A knob 64 is secured to the threaded shaft 62 opposite of the threaded end of the threaded shaft 62. An interiorly threaded member 68 is threadably secured coaxially to the threaded shaft 62. The interiorly threaded member 68 projects parallel along the inner surface of the lower plate 46 by threadably engaging the threaded shaft 62. An elongated tapered member 69 has a narrow end and a broad end as best shown in FIG. 4 of the drawings. The elongated tapered member 69 also has a slot 61 extending from the narrow end to near the broad end. The slot 61 receives the upper contact 58 and the insulated tube 56 slidably as shown in FIG. 4. The insulated compression spring 51 is mesial the upper plate 44 and the elongated tapered member 69. The upper contact 58 projects through the slot 61 to engage the lower contact 59 to close the circuit. The broad end is secured to the interiorly threaded member 68 for allowing projecting of the elongated tapered member 69 parallel to the lower plate 46 for increasing or decreasing a compression force within the insulated compression spring 51. A flexible side cover 48 is secured to the upper plate 44 and the lower plate 46 near the outer perimeter for protecting the pressure switch 50 and the weight adjustment means 60.

As shown in FIGS. 1 and 2, the alarm clock 30 has a speaker 32 which audibly emits the alarm. An alarm controller 31 is electrically coupled to the speaker 32 for controlling the alarm as to whether the alarm is a radio station or a buzzer. A display 34 for showing the current time of day is electrically coupled to a unnumbered microprocessor within the alarm clock 30. The unnumbered microprocessor is electrically coupled to the alarm controller 31. A volume control 36 is electrically coupled mesial the speaker 32 and the alarm controller 31. A power cord 38 is electrically coupled to the unnumbered microprocessor for providing a power source to the unnumbered microprocessor.

In an alternative embodiment as shown in FIG. 5 of the drawings, a heat sensing pad 70 is utilized instead of the pressure sensing means 40. The heat sensing pad 70 is positioned onto the cornice of said mattress 24 for detecting the body heat from the user 12. When the body heat is detected, operation of the alarm is allowed, whereas when no body heat is detected, operation of the alarm is terminated.

In use, the user 12 positions himself or herself upon the mattress 24. The weight of the user 12 forces the mattress 24 upon the pressure sensing means 40 thereby closing the circuit within the upper electrode 52 and the lower electrode 54. When the unnumbered microprocessor within the alarm clock 30 activates the alarm, the user gets out of bed 20. When getting out of bed 20, pressure is taken off the pressure sensing means 40 thereby opening the circuit which terminates sounding of the alarm. If the user chooses to go back to bed 20 before a finite period after termination of the alarm, the circuit is closed again thereby activating the alarm.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pressure controlled alarm clock system comprising:

an alarm clock programmable to sound an alarm at a preset time; and a pressure sensing means connected to said alarm clock and positioned between a box spring and a mattress of a bed, where the weight of a user forces said mattress upon said pressure sensing means which allows said alarm clock to sound said alarm and upon said user's removal from said bed said alarm is terminated;

wherein said pressure sensing means comprises:

a cylinder;

an upper plate pivotally secured to said cylinder;

a lower plate pivotally secured to said cylinder forming a syncline shape;

a pressure switch between said upper plate and said lower plate, where said pressure switch is in communication with said alarm clock controlling said alarm.

2. The pressure controlled alarm clock system of claim 1 wherein said pressure switch comprises:

an upper electrode juxtaposed to an inner surface of said upper plate and electrically coupling to said alarm clock by a communication cable;

a lower electrode juxtaposed to an inner surface of said lower plate and electrically coupling to said alarm clock by said communication cable;

an insulated tube secured orthogonally to said inner surface of said upper plate concentrically, where said upper electrode projects into said insulated tube;

an upper contact extending from within said insulated tube a finite distance towards said lower plate, where said upper contact is electrically coupled to said upper electrode;

an insulated compression spring slidably surrounding said upper contact and said insulating tube, where said spring is mesial said upper plate and said lower plate for forcing said plates apart; and a lower contact secured to said inner surface of said lower plate and electrically coupled to said lower electrode, where said lower contact becomes electrically engaged to said upper contact upon an application of force by said user's weight upon said mattress thereby closing a circuit through said communication cable to allow sounding of said alarm.

3. The pressure controlled alarm clock system of claim 1 wherein said pressure switch includes a weight adjustment means for allowing said user to preset the weight sensitivity of said pressure switch.

4. The pressure controlled alarm clock system of claim 3 wherein said weight adjustment means comprises:

a support member secured to said inner surface of said lower plate opposite of said cylinder orthogonally;

a threaded shaft rotatably projects through said support member parallel to said lower plate;

a knob secured to said threaded shaft opposite of the threaded end of said threaded shaft;

an interiorly threaded member threadably secured coaxially to said threaded shaft, where said interiorly threaded member is projected parallel along said inner surface of said lower plate;

an elongated tapered member having a narrow end and a broad end;

said elongated tapered member including a slot extending from said narrow end to near said broad end, where said slot receives said upper contact and said insulated tube slidably, and where said insulated compression spring is located between said upper plate and said elongated tapered member; and said broad end secured to said interiorly threaded member for allowing projecting of said elongated tapered member parallel to said lower plate for increasing or decreasing a compression force within said insulated compression spring.

5. The pressure controlled alarm clock system of claim 4 wherein a flexible side cover is secured to said upper plate and said lower plate near the outer perimeter for enclosing said pressure switch and said weight adjustment means.

6. The pressure controlled alarm clock system of claim 1 wherein said alarm clock includes:

a speaker sounding said alarm;

an alarm controller electrically coupled to said speaker for controlling said alarm;

a display for showing the current time of day electrically coupled to a microprocessor, where said microprocessor is electrically coupled to said alarm controller;

a volume control electrically coupled between said speaker and said alarm controller; and a power cord electrically coupled to said microprocessor for providing a power source.

* * * * *